US005530214A

United States Patent [19]

Morehead et al.

[11] Patent Number: 5,530,214

[45] Date of Patent: Jun. 25, 1996

[54] VENTURI MUFFLER

[75] Inventors: Clyde A. Morehead; John W. Henry, V, both of Annapolis, Md.

[73] Assignee: The United States of America as represented by the Secretary of the Navy, Washington, D.C.

[21] Appl. No.: 309,520

[22] Filed: Sep. 20, 1994

[51] Int. Cl.[6] ..... F01N 1/00

[52] U.S. Cl. ..... 181/255; 181/229

[58] Field of Search ..... 181/247, 248, 181/249, 250, 255, 282, 229, 224, 230

[56] References Cited

U.S. PATENT DOCUMENTS

| | | | |
|---|---|---|---|
| 1,611,475 | 12/1926 | Maxim | 181/248 |
| 2,828,189 | 3/1958 | Houdry | 181/258 |
| 4,361,206 | 11/1982 | Tsai | 181/255 |
| 4,501,341 | 2/1985 | Jones | 181/250 |
| 4,690,245 | 9/1987 | Gregorich et al. | 181/249 X |
| 4,693,339 | 9/1987 | Beale et al. | 181/255 |

*Primary Examiner*—Khanh Dang
*Attorney, Agent, or Firm*—Gary G. Borda

[57] ABSTRACT

A muffler for a gas flow at a gas intake of a machine consists of a venturi nozzle cooperating with a chamber. The venturi nozzle has an inlet opening and outlet opening. The chamber has a gas inlet connected to one of the inlet opening and the outlet opening of the venturi nozzle. The chamber has a gas outlet connected to the gas intake of the machine.

14 Claims, 1 Drawing Sheet

VENTURI MUFFLER

The invention described herein may be manufactured and used by or for the Government of the United States of America for governmental purposes without payment of any royalties thereon or therefor.

FIELD OF THE INVENTION

The invention relates generally to mufflers, and more particularly to a muffler that attenuates low frequency noise generated at the gas intake of compressors, internal combustion engines, or other machines that produce noise during the process of taking in air or other gases.

BACKGROUND OF THE INVENTION

Machines such as air compressors and internal combustion engines—especially diesel engines—produce high level pulsations at multiples of the machine's rotational speed that may extend over a wide frequency range. Mufflers used to reduce intake pulsation noise generally are dissipative or reactive or a combination of the two. To be effective at low frequencies (i.e., below 500 Hz) and over a broad frequency range, these types of mufflers must be very large and heavy. Most reciprocating compressors generally have first order pulsation frequencies in the 7 to 20 Hz range and produce significant intake noise at multiples of the pulsation frequency up to frequencies in the 300–400 Hz range. However, even large mufflers can generally only attenuate tones by less than 6 dB below 30 Hz. To compensate for such low frequency deficiency, tuned filters may be designed for the low frequencies. However, the tuned filters are effective only over a very limited frequency range.

SUMMARY OF THE INVENTION

Accordingly, it is an object of the present invention to provide a muffler that attenuates low frequency noise generated at the gas intake of a machine.

Another object of the present invention is to provide a muffler that attenuates noise generated over a broad range of frequencies at the gas intake of a machine.

Other objects and advantages of the present invention will become more obvious hereinafter in the specification and drawings.

In accordance with the present invention, a muffler for attenuation of low frequency noise at a gas intake of a machine consists of a venturi nozzle cooperating with a chamber. The venturi nozzle has an inlet opening and outlet opening. The chamber has a gas inlet connected to one of the inlet opening and the outlet opening of the venturi nozzle. The chamber further has a gas outlet connected to the gas intake of the machine. A flow of a gas reaches the gas intake of the machine by sequentially passing from the inlet opening, through the venturi nozzle, through the outlet opening, through at least a portion of the chamber, and through the gas outlet.

DETAILED DESCRIPTION OF THE INVENTION

Figure 1:
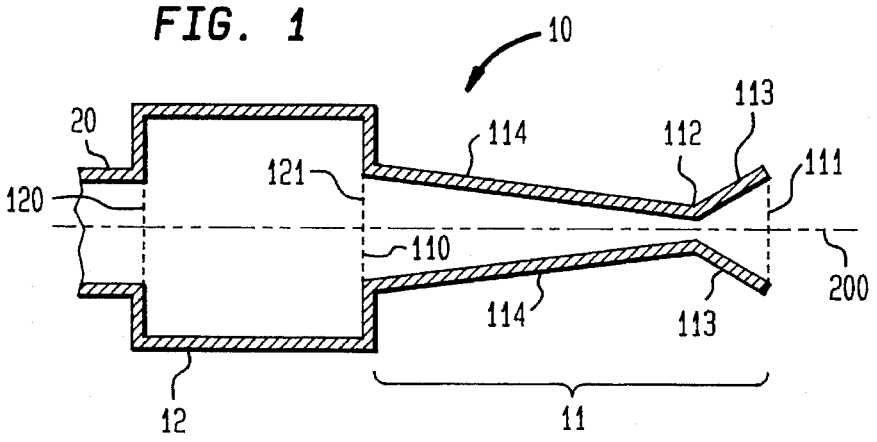
FIG. 1 is a side, cross-sectional view of a muffler according to one embodiment of the present invention.

Referring now to the drawings, and more particularly to FIG. 1, one embodiment of muffler 10 is shown in cross-section. Muffler 10 consists of venturi nozzle 11 connected to chamber 12. The outlet of chamber 12, indicated by the dashed line tagged with the reference numeral 120, is connected to intake 20 of a machine (not shown) such as an air compressor (piston or screw type), internal combustion engine or any other machine that produces noise while taking in air or other gases through intake 20. Accordingly, the present invention will be described as it relates to low frequency acoustic noise generally associated with such machines.

In the FIG. 1 embodiment, inlet 121 of chamber 12 is connected to diverging outlet opening 110 of venturi nozzle 11. Thus, inlet 121 and diverging outlet opening 110 are referenced to the same dashed line in FIG. 1. At the opposite end of venturi nozzle 11 is the nozzle's converging inlet opening as indicated with the dashed line tagged by reference numeral 111. Finally, venturi nozzle 11 includes venturi throat 112 for increasing the speed of a gas flow therethrough to sonic (or near sonic) velocity. Briefly, venturi nozzle 11 delivers gas to chamber 12 with minimum loss while increasing the gas velocity to sonic (or near sonic) velocity at venturi throat 112 during the intake stroke of the machine connected to intake 20. Chamber 12 serves as a reservoir of intake gas for the machine to draw from when there is inadequate flow through venturi throat 112.

To prevent loss of compression efficiency for a compressor, or charge efficiency for an engine, chamber 12 must be sized to provide an adequate supply of intake gas to outlet 120 during the machine's intake stroke. When gas flow through venturi throat 112 becomes inadequate during the intake stroke, the machine can draw from a reserve gas volume within the volume formed by intake 20 and venturi muffler 10. The reserve gas volume provided by venturi muffler 10 includes chamber 12 and the divergent outlet section of venturi nozzle 11 residing between venturi throat 112 and divergent outlet opening 110. The total reserve volume (which includes the volume of intake 20) must be sized to compensate for any inadequate flow through venturi throat 112. Thus, the size of venturi muffler 10 is predicated upon how continuous the gas flow is into the machine. For machines with discontinuous intake flows, such as a single-acting reciprocating compressor, the total reserve volume should be approximately 10 times greater than the volume of gas required for each intake stroke. For machines that have a more continuous intake flow, such as a screw type compressor or multi-cylinder engine, the total reserve volume should be approximately 3 times greater than the volume of gas required for each intake stroke. For turbomachinery that is characterized by a continuous non-fluctuating intake flow, the reserve volume provided by the divergent outlet section of venturi nozzle 11 residing between venturi throat 112 and divergent outlet opening 110 is sufficient.

In terms of noise associated with the machine's intake of air or other gases, the area defined by venturi throat 112 is sized to increase the speed of the gas flowing therethrough to sonic (or near sonic) velocity during each intake stroke. This is done because sound cannot propagate past venturi throat 112 (towards inlet opening 111) as long as the gas velocity therethrough (towards outlet opening 110) is in the sonic region. For machines with a discontinuous intake flow, such as a single-acting reciprocating compressor, venturi throat 112 is sized to achieve an average throat velocity of 0.7 times sonic velocity. For machines having a more continuous intake of gas, such as a screw type compressor or multi-cylinder engine, venturi throat 112 is sized to achieve an average throat velocity of 0.9 times sonic velocity. For turbomachinery, venturi throat 112 is sized to achieve sonic velocity therethrough.

The angles and lengths of walls 113 and 114 leading to and from, respectively, venturi throat 112 are selected in accordance with standard venturi nozzle design criteria as is well understood in the art. In the preferred embodiment, the angles and lengths of walls 113 and 114 are further selected such that each of the flow area defined by inlet opening 111, the flow area defined by outlet opening 110 (and that defined by inlet 121 in the FIG. 1 embodiment), and the flow area of outlet 120, is equal to the flow area of intake 20. Alternatively, the length of walls 113 and 114 can be shortened along with proportional reductions in the respective diameters of inlet opening 111 and outlet opening 110. Note that while this alternative can cause some additional pressure drop across venturi nozzle 11, there is no loss in acoustic effectiveness.

Figure 2:
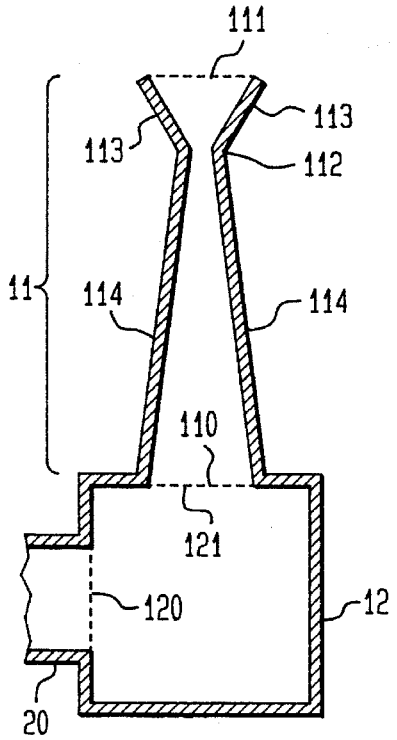
FIG. 2 is a side, cross-sectional view of a muffler according to another embodiment of the present invention.

Although the present invention has been described for the embodiment shown in FIG. 1, it is not so limited. For example, venturi nozzle 11 and chamber 12 in FIG. 1 are arranged so that inlet opening 111, outlet opening 110 (and inlet 121), and outlet 120 are all aligned along a common axis indicated by the dashed line tagged with reference numeral 200. However, space or other constraints may require that venturi nozzle 11 cooperate with chamber 12 in such a way that all openings through venturi nozzle 11, chamber 12 and intake 20 are not aligned with one another. One such scenario of this sort is represented by the embodiment shown in FIG. 2 where like reference numerals have been used for those elements in common with FIG. 1. In FIG. 2 outlet opening 110 of venturi nozzle 11 is positioned perpendicular to that of outlet 120 leading to intake 20. Naturally, outlet opening 110 and outlet 120 can form other angles with respect to one another depending on space or other constraints.

Figure 3:
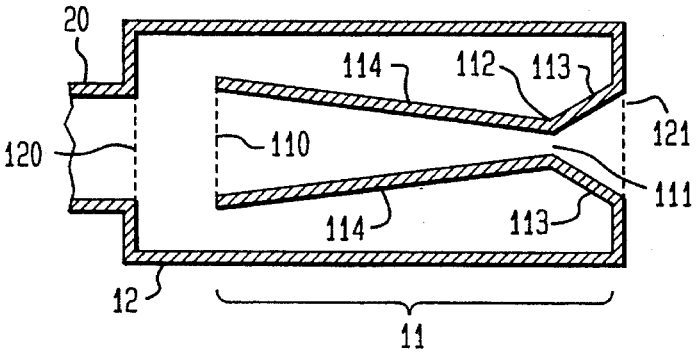
FIG. 3 is a side, cross-sectional view of a muffler according to yet another embodiment of the present invention.

In still another embodiment of the present invention, venturi nozzle 11 can be enclosed within chamber 12 for a more compact design as shown in FIG. 3. Once again, like reference numerals are used for those elements in common with FIG. 1. To accomplish the compact design of FIG. 3, inlet opening 111 of venturi nozzle 11 is made coincidental with that of inlet 121 associated with chamber 12. Outlet opening 110 of venturi nozzle 11 resides within chamber 12 as shown.

The advantages of the present design are numerous. A muffler built in accordance with the present invention attenuated intake noise of a reciprocating compressor by 15–29 dB over the 15–350 Hz frequency range (i.e., the frequency range over which the intake noise of reciprocating compressors is prominent). Another muffler built in accordance with this invention attenuated intake noise of a screw compressor 7–9 dB more than a much heavier and larger commercial muffler at frequencies below 350 Hz. In both cases, attenuation was achieved with no more pressure drop than caused by a conventional reactive or dissipative muffler.

Although the invention has been described relative to specific embodiments thereof, there are numerous other variations and modifications that will be readily apparent to those skilled in the art in the light of the above teachings. For example, while venturi nozzles are typically circular in cross-section, the present invention would work equally as well with venturi nozzles having other cross-sectional shapes such as rectangular or polygonal. It is therefore to be understood that, within the scope of the appended claims, the invention may be practiced other than as specifically described.

What is claimed is:

1. A muffler for connecting to a gas intake of a machine that produces noise while taking in a gas flow through the gas intake, said muffler comprising:

a venturi nozzle having an inlet opening defining a plane and an outlet opening defining a plane; and a chamber having a gas inlet defining a plane, said gas inlet connected to one of said inlet opening and said outlet opening such that said plane of said gas inlet coincides with said plane of said one of said inlet opening and said outlet opening, said chamber further having a gas outlet connected to the gas intake of the machine, wherein said inlet opening, said outlet opening, said gas inlet and said gas outlet are identically sized such that respective flow areas defined by said inlet opening, said outlet opening, said gas inlet and said gas outlet are equal to a flow area defined by the gas intake of the machine.

2. A muffler as in claim 1 wherein said inlet opening, said outlet opening, said gas inlet and said gas outlet are aligned with one another.

3. A muffler as in claim 1 wherein each of said inlet opening, said outlet opening, said gas inlet and said gas outlet are circular.

4. A muffler as in claim 1 wherein said gas inlet is connected to said outlet opening.

5. A muffler as in claim 4 wherein said venturi nozzle is outside of said chamber.

6. A muffler as in claim 1 wherein said gas inlet is connected to said inlet opening.

7. A muffler as in claim 6 wherein said chamber encloses said venturi nozzle.

8. A muffler for attenuation of low frequency noise at a gas intake of a machine, said machine of the type requiring a known volume of a gas at said gas intake during an intake stroke of said machine, the noise arising during each said intake stroke, said muffler comprising:

a venturi nozzle having an inlet opening and an outlet opening; and a chamber having a gas inlet connected to one of said inlet opening and said outlet opening, said chamber further having a gas outlet connected to said gas intake, wherein a flow of said gas reaches said gas intake by sequentially passing from said inlet opening, through said venturi nozzle, through said outlet opening, through at least a portion of said chamber, and through said gas outlet, wherein said venturi nozzle includes a throat passage between said inlet opening and said outlet opening, a converging portion between said inlet opening and said throat passage and a diverging portion between said throat passage and said outlet opening, said throat passage being sized to increase an average speed of said flow of said gas to the range of approximately 0.7–1.0 times sonic velocity, and wherein said diverging portion and said chamber enclose a reserve gas volume equal to between about 1 and about 10 times said known volume of gas required for each said intake stroke wherein said reserve gas volume is sized to provide an adequate supply of an intake gas to said gas outlet during said intake stroke of said machine.

9. A muffler as in claim 8 wherein said inlet opening, said outlet opening, said gas inlet and said gas outlet are circular, and further wherein said inlet opening, said outlet opening, said gas inlet and said gas outlet are substantially identically sized such that respective flow areas defined by said inlet opening, said outlet opening, said gas inlet and said gas outlet are substantially equal to a flow area defined by the gas intake of said machine.

10. A muffler as in claim 8 wherein said inlet opening, said outlet opening, said gas inlet and said gas outlet are aligned with one another.

11. A muffler as in claim 9 wherein said gas inlet is connected to said outlet opening and projects entirely outside of said chamber.

12. A muffler as in claim 9 wherein said gas inlet is connected to said inlet opening and wherein said chamber encloses all of said venturi nozzle.

13. A muffler as in claim 9 wherein said machine is chosen from the group consisting of single-acting reciprocating machinery having discontinuous intake flows, multi-cylinder reciprocating machinery, and turbomachinery having continuous non-fluctuating intake flow, and wherein said throat passage is sized to increase average speed of said flow of said gas to approximately 0.7 times sonic velocity for said single-acting reciprocating machinery, to about 0.9 times sonic velocity for said multi-cylinder machinery, and to about sonic velocity for said turbomachinery.

14. A muffler as in claim 9 wherein said machine is chosen from the group consisting of single-acting reciprocating machinery having discontinuous intake flows, multi-cylinder reciprocating machinery, and turbomachinery having continuous non-fluctuating intake flow, and wherein said reserve gas volume is equal to about 10 times said known volume for said single-acting reciprocating machinery, said reserve gas volume is equal to about 3 times said known volume for said multi-cylinder reciprocating machinery, and said reserve gas volume is equal to about 1 times said known volume for said turbomachinery.

* * * * *